US009434511B1

(12) United States Patent
Zimmer

(10) Patent No.: US 9,434,511 B1
(45) Date of Patent: Sep. 6, 2016

(54) STYLING CHAIR TOTE BAG

(71) Applicant: Jin J. Zimmer, Cumming, GA (US)

(72) Inventor: Jin J. Zimmer, Cumming, GA (US)

( * ) Notice: Subject to any disclaimer, the term of this patent is extended or adjusted under 35 U.S.C. 154(b) by 38 days.

(21) Appl. No.: 14/788,359

(22) Filed: Jun. 30, 2015

(51) Int. Cl.
*B65D 25/22* (2006.01)
*B65D 43/22* (2006.01)

(52) U.S. Cl.
CPC ..... *B65D 25/22* (2013.01); *B65D 43/22* (2013.01); *B65D 2543/00574* (2013.01)

(58) Field of Classification Search
CPC ..... B65D 25/22; B65D 43/22; B65D 2543/00574
USPC ..... 220/230, 480, 476, 481; 248/317
See application file for complete search history.

(56) References Cited

U.S. PATENT DOCUMENTS 2,876,980 A * 3/1959 Salter ..... A45C 13/00 248/206.3
5,850,956 A * 12/1998 Hayward, Jr. ..... A45F 5/00 108/43
8,807,376 B1 * 8/2014 Mastors ..... A61M 5/1418 220/481
9,055,805 B2 * 6/2015 Koutouras ..... A45C 13/02
2004/0188482 A1 * 9/2004 Wilson ..... A45C 3/10 224/576
2011/0240692 A1 * 10/2011 Park ..... A45C 5/02 224/155
2014/0373985 A1 * 12/2014 Pace ..... A45C 3/001 150/105
2016/0052710 A1 * 2/2016 Butler ..... B65F 1/141 220/560

* cited by examiner

*Primary Examiner* — Robert J Hicks
*Assistant Examiner* — Kareen Thomas
(74) *Attorney, Agent, or Firm* — Dunlap Bennett & Ludwig PLLC

(57) ABSTRACT

An article container adapted to removably attach to furniture is provided. The article container may form an enclosure that is enclosed by a movable flap. The article container may provide cooperating straps and buckles for removably securing to the arm rest of the furniture. The article container may be adapted to prevent unwanted objects from contacting the articles retained in the enclosure.

6 Claims, 3 Drawing Sheets

STYLING CHAIR TOTE BAG

BACKGROUND OF THE INVENTION

The present invention relates to containers and, more particularly, to an article container adapted to removably attach to furniture.

Currently when customers get their hair cut or colored they put their purse on the floor besides the styling chair. More often than not, the cut hair clings to the customer's purse. As a result, after they finish with their hair appointment the customer then has to brush off the hair particles from the purse.

As can be seen, there is a need for an article container adapted to removably attach to furniture so that articles need not rest on the floor when their owners sit on the furniture.

SUMMARY OF THE INVENTION

In one aspect of the present invention, an article container includes a plurality of walls forming an enclosure having an opening; a flap attached along a portion of a periphery of the opening, wherein the flap is movable from an open position to a closed position, preventing access to the enclosure; and at least one pair of a strap and buckle assembly for removably mounting the article container to an elongated member.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an article container adapted to removably attach to furniture so that articles need not rest on the floor when their owner's sit on the furniture. The article container may form an enclosure that is enclosed by a movable flap. The article container may provide cooperating straps and buckles for removably securing to the arm rest of the furniture. The article container may be adapted to prevent unwanted objects from contacting the articles retained in the enclosure.

Figure 6:
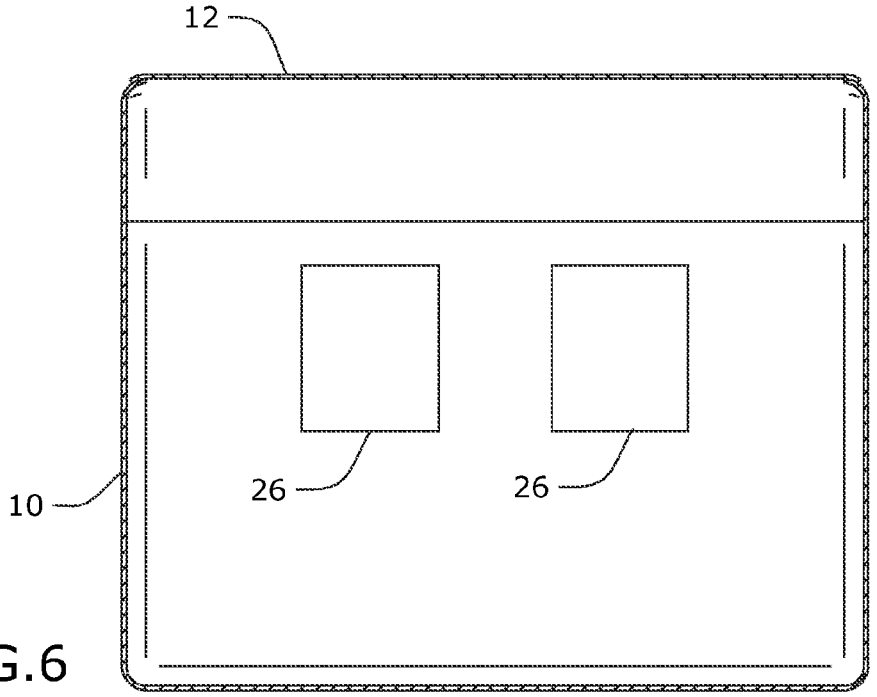
FIG. 6 is a section detail view of an examplary embodiment of the present invention, taken along line 6-6 in FIG. 2.

Referring to FIGS. 1 through 6, the present invention may include an article container 10. The article container 10 may have a plurality of walls that form an enclosure having an opening, wherein the opening and the enclosure are dimensioned and adapted to receive and retain, respectively, a plurality of various articles 24. The article container 10 may be made of any suitable material that is durable and can be repeatedly bent without fracturing, such as leather, nylon, various plasticized materials and the like. The articles 24 may be accessories an individual typically carries with them, such as a purse, handbag, hat, scarf, keys, wallets, and the like. The enclosure may form at least one inner pocket 26, as illustrated in FIG. 6. for separately retaining other articles 24 or sundry objects.

The article container 10 may provide a flap 12 disposed along a first portion of a periphery of the opening, wherein the flap 12 is dimensioned to extend over the entirety of the opening to a second portion of the periphery of the opening, thereby enclosing the enclosure. The flap 12 may be connected to the periphery of the opening so as to be movable from an open position to a closed position, preventing objects from entering the enclosure. At least one pair of cooperating fasteners 18 may be disposed on the flap 12 and on the article container 10 near and inward from the second portion of the periphery of the opening, whereby the flap 12 can be removably secured in the closed position. In certain embodiments, the at least one cooperating fastener 18 may be on an inner portion of the flap and an outer portion of the plurality of walls.

The at least one pair of cooperating fasteners 18 may be any fasteners known in the art for fastening or removably securing one object to another including, for example, standard push-button snaps, Velcro-type fasteners, adhesive substances, magnets, combinations thereof, and the like, so long as the least one pair of cooperating fasteners 18 function in accordance with the present invention as described herein.

Figure 1:
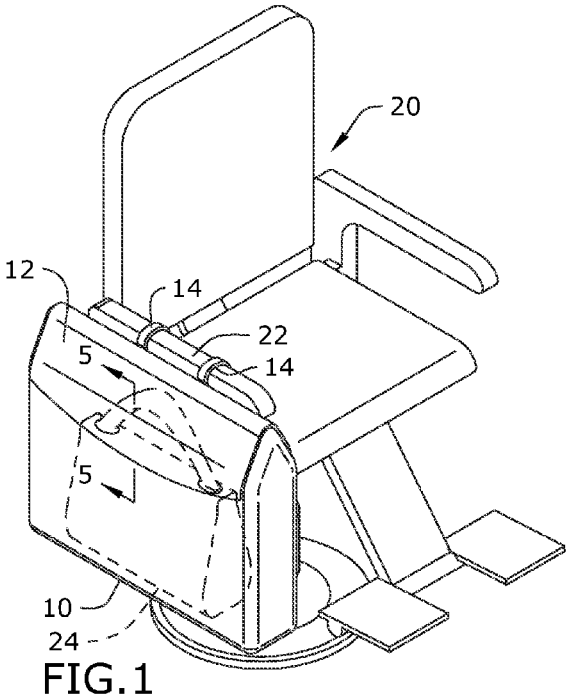
FIG. 1 is a perspective view of an examplary embodiment of the present invention, shown in use.
Figure 2:
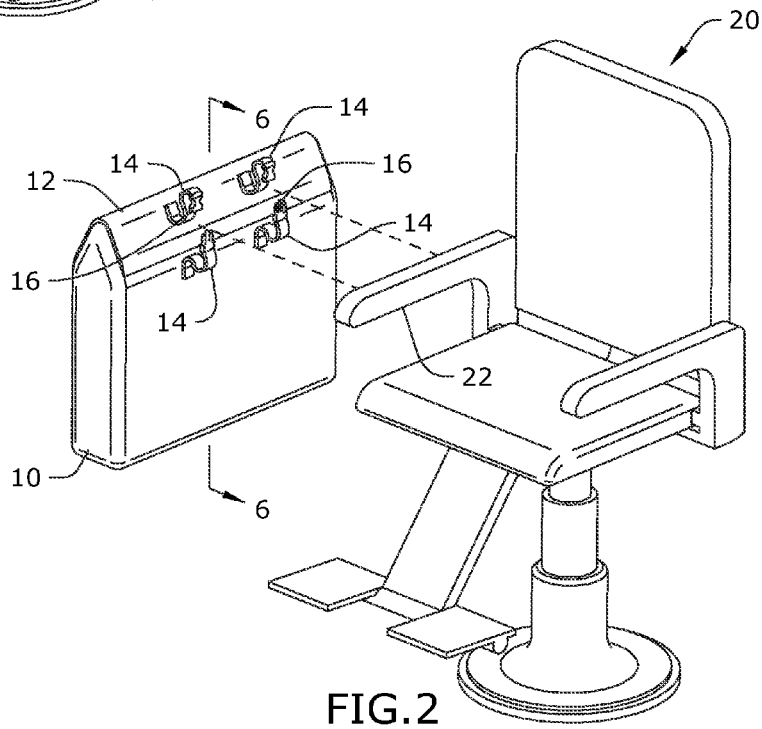
FIG. 2 is an exploded view of an examplary embodiment of the present invention.
Figure 3:
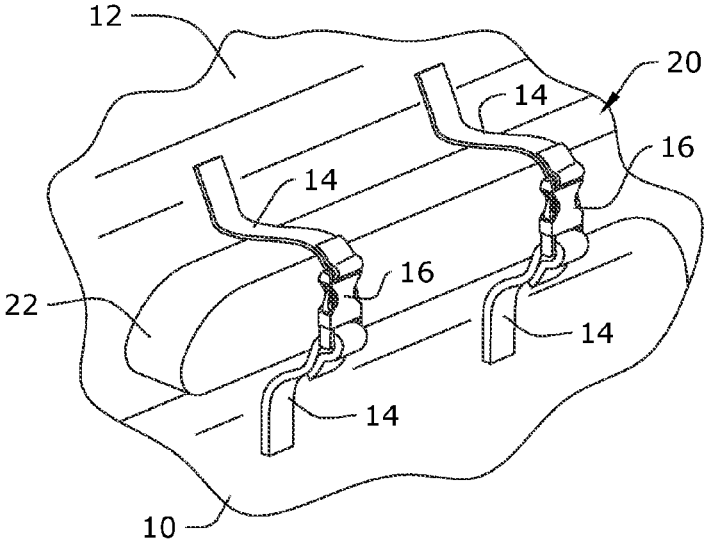
FIG. 3 is a perspective detail view of an examplary embodiment of the present invention.
Figure 4:
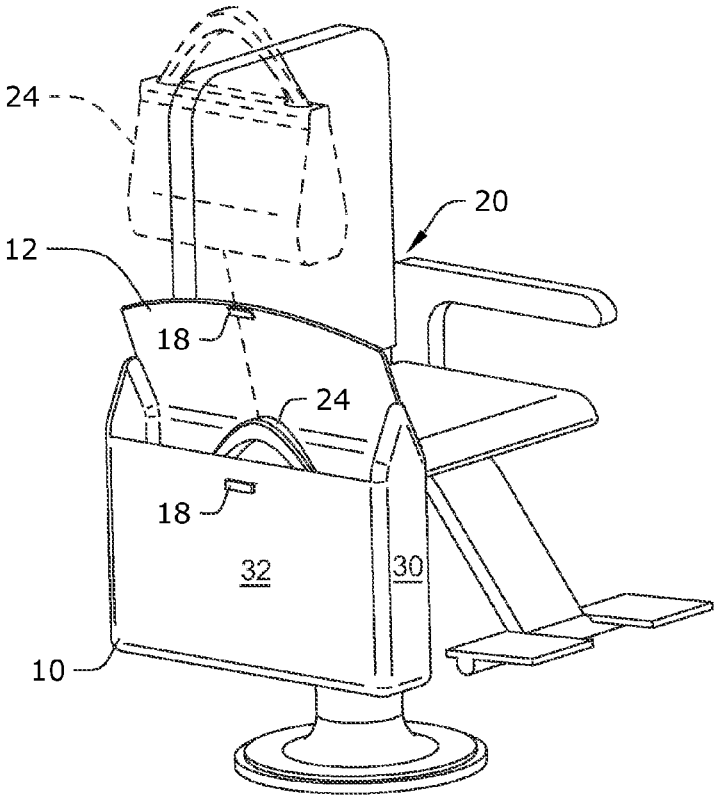
FIG. 4 is a exploded view of an examplary embodiment of the present invention, demonstrating insertion of an article into the present invention.
Figure 5:
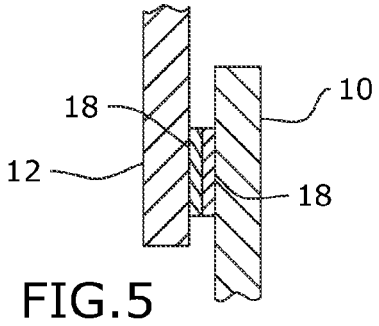
FIG. 5 is a section detail view of an examplary embodiment of the present invention, taken along line 5-5 in FIG. 1.

At least one pair of adjustable straps 14 may be disposed on the flap 12 and on the article container 10 near and inward from the second portion of the periphery of the opening. Each strap 14 of the pair may terminate in complementary buckles 16, as illustrated in FIG. 2. The complementary buckles 16 may be parachute buckles or the like. Each adjustable strap 14 and complementary buckles 16 may be dimensioned and adapted to removably mount the article container 10 to an arm 22 of an article of furniture 20, whereby each adjustable strap 14 may be cinched to further secure the mounting. In other words, the article container 10 may provide at least one pair of strap and buckle assembly for removably mounting the article container to an elongated member, such as the arm of a chair. The article of furniture 20 may be a sofa, couch, chair, such as a styling chair, as illustrated in FIGS. 1, 2 and 4.

In certain embodiments, the plurality of walls may include two opposing side walls 30. Each side wall 30 may have a rectangular portion extending to a triangular portions, as illustrated in FIG. 4. Along a periphery of the rectangular portions not extending to the triangular portion, at least one remaining wall 32 may be joined so as to interconnect the two opposing side walls 30 and form the enclosure. A portion of the at least one remaining wall 32 may extend to form the flap 12. The overall shape of the article container 10 may be reminiscent of an elongated silo with a pitched top, as illustrated in the FIGS. The pitched portion of the elongated silo formed by the triangular portions enable elbow room when the article container 10 is mounted to the arm 22 of a, say, styling chair 24.

A method of using the present invention may include the following. The article container 10 disclosed above may be provided. A user, say, a hair stylist, may secure the article container 10 to the arm 22 of their styling chair 20 by using the adjustable straps 14 and complementary buckles 16. The article container 10 may be oriented so that the opening is upward-facing relative to an individual sitting in the styling chair 20. In the open position, the individual may place their articles 24 in the article container 10; for instance, a purse in the enclosure and their keys in one of the inner pockets 26. Then the individual may move the flap 12 to the closed position, preventing hair cuttings from falling on and clinging to their articles 24.

It should be understood, of course, that the foregoing relates to exemplary embodiments of the invention and that modifications may be made without departing from the spirit and scope of the invention as set forth in the following claims.

What is claimed is:

1. An article container for removably mounting to an arm rest, comprising:

a plurality of walls comprising two sidewalls, wherein the plurality of walls form an enclosure having an opening, the opening having a periphery defined by a first portion, a second portion and two side portions;

a flap attached along the first portion, wherein the two opposing sidewalls define the two side portions so that each side portion extends inwardly from the first portion to an apex cresting at a midpoint of each side portion, and wherein the flap is movable from an open position to a closed position, forming a shape that is defined by the two side portions; and at least one pair of a strap and buckle assembly for removably mounting the article container to an elongated member, wherein the periphery of the opening is dimensioned so that the apex abuts the arm rest without being upward of the arm rest when the article container is mounted to the arm rest, whereby elbow room is available in a space adjacent to the arm rest and over a portion of the opening.

2. The article container of claim 1, further comprising at least two cooperating fasteners, wherein at least one of the at least two cooperating fasteners is disposed on an inner portion of the flap and at least one of the at least two cooperating fasteners is disposed on an outer portion of the plurality of walls.

3. The article container of claim 2, wherein the at least two cooperating fasteners are magnets.

4. The article container of claim 3, wherein the enclosure forms at least one inner pocket.

5. The article container of claim 1, wherein the two opposing sidewalls are made of a durable material so that the two sidewalls maintain an upright orientation when the article container is mounted to the arm rest.

6. The article container of claim 1, wherein the second portion is co-planar with the first portion so that the shape of the flap in the closed position is symmetrical about the midpoint of each side portion.

* * * * *